US005297848A

United States Patent [19]

Grinnell

[11] Patent Number: 5,297,848

[45] Date of Patent: Mar. 29, 1994

[54] PORTABLE, ORTHOPEDICALLY CORRECT, ADJUSTABLE SEATING CUSHION

[76] Inventor: Sandra H. Grinnell, 331 Anita Dr., Pasadena, Calif. 91105

[21] Appl. No.: 912,739

[22] Filed: Jul. 13, 1992

[51] Int. Cl.[5] ..... A47C 27/00

[52] U.S. Cl. ..... 297/219.1; 297/230.14; 297/284.5

[58] Field of Search ..... 297/219, 230, 231, 284.5, 297/382, DIG. 1, 458, 460, 229

[56] References Cited

U.S. PATENT DOCUMENTS

| | | | |
|---|---|---|---|
| D. 258,482 | 3/1981 | Strock | D6/204 |
| D. 268,976 | 5/1983 | Ross | D6/201 |
| D. 279,642 | 7/1985 | Ross | D6/596 |
| D. 293,868 | 1/1988 | Paletta et al. | D6/596 |
| 2,218,951 | 10/1940 | Flaharty | 297/219 |
| 2,734,556 | 2/1956 | Hebrank | 297/219 X |
| 3,226,157 | 12/1965 | Reinfeldt et al. | 297/219 |
| 3,747,977 | 7/1973 | Rowland | 297/445 |
| 4,190,918 | 3/1980 | Harvell | 5/465 |
| 4,457,032 | 7/1984 | Clarke | 5/481 |
| 4,597,605 | 7/1986 | Gilbert | 297/219 |
| 4,630,863 | 12/1986 | Roberts | 297/219 |
| 4,752,982 | 6/1988 | Jones et al. | 5/433 |
| 4,824,169 | 4/1989 | Jarell | 297/284.5 X |
| 4,925,241 | 5/1990 | Geraci | 297/219 X |
| 4,951,336 | 8/1990 | Silverman | 5/481 |

FOREIGN PATENT DOCUMENTS

| | | | |
|---|---|---|---|
| 121224 | 6/1927 | Switzerland | 297/231 |

*Primary Examiner*—Laurie K. Cranmer

[57] ABSTRACT

An apparatus is provided for supporting a seated person. A seatrest cushion, supported by a chair seat, has a back edge and an upward facing convex surface for receiving the thighs and buttocks of the seated person. A backrest cushion has a horizontal bottom edge and an outward facing convex surface for receiving the back of the seated person. A flexible attachment strip tethers the back edge of the seatrest cushion to the bottom edge of the backrest cushion and is capable of being folded or unfolded for moving the cushions closer together or farther apart, respectively. The backrest cushion is positionable over a wide range of angles with respect to the seatrest cushion for supporting a person in a partially reclined orientation. The strip supports the cushions in alignment. An adjustable carrying strap is attached to the attachment strip for carrying the apparatus. The carrying strap may be used to support the apparatus during portage, and may also be used to hold the seatrest cushion in position on the chair seat during use by looping the carrying strap around the backrest of the chair seat. A carrying handle may be attached to the strip for carrying the apparatus by hand.

9 Claims, 2 Drawing Sheets

PORTABLE, ORTHOPEDICALLY CORRECT, ADJUSTABLE SEATING CUSHION

FIELD OF THE INVENTION

This invention relates generally to seat cushions, and, more particularly, to an orthopedically correcting seat cushion.

BACKGROUND OF THE INVENTION

Portable cushions are frequently used to increase the comfort of chairs, car seats, benches, and the like. Such prior art devices have generally attempted to either improve the convenience and portability of such cushions, or to improve the supporting shape of the cushions. For example, U.S. Pat. No. 4,190,918 to Harvell on Mar. 4, 1980, teaches a cushion device with improved portability in that two cushions are flexibly attached and carryable with a handle arrangement. Such a device is easier to carry than two separate cushions. Another such device is illustrated in U.S. Pat. No. De. 258,482 to Strock on Mar. 10, 1981. Both of these devices, however, require carrying by hand, which can be inconvenient if both hands are needed elsewhere. Moreover, people with back problems will find supporting such a device with one arm uncomfortable and potentially harmful to the back, especially if side pockets of such a device are heavily loaded.

Another device, disclosed in U.S. Pat. No. De. 279,642 to Ross on Jul. 16, 1985, is typical of back cushioning devices with contoured supporting shape for the lumbar region of a person's back. U.S. Pat. No. De. 268,976, issued on May 17, 1983, also to Ross, illustrates another such device. Such devices, however, are most effective when used in combination with a supporting seat cushion. Such a device is inconvenient to carry from place to place with a separate seat cushion device, and therefore such devices are limited in their usefulness as portable items with two separate parts.

Accu-Back, Inc., of California, makes available an orthopedic foam wedge which serves as a supporting seat cushion. With the thickest portion of the wedge behind the knees, the thighs are elevated, thereby attempting a more natural, neutral position of the pelvis. However, such a wedge has limited effectiveness when used for extended periods of time, even when used with a supporting back cushion as suggested by the manufacturer. When elevating the thighs, such a wedge transfers body weight onto the coccyx and ischia, which often causes poor circulation and pressure pain in that area when sitting for extended periods. Moreover, the right angle corner design of the typical wedge device increase pressure against the back of the knees which may cause a reduction in blood circulation and cramping in the lower legs and feet. The manufacturer notes that such a wedge device may be used with the thickest portion under the buttocks, thereby relieving some pressure from the ishia and coccyx. Such a configuration is often recommended for people having injuries to the coccyx, or tenderness after surgery or childbirth, and the like. However, in such a wedge configuration, the pelvis may be forced out of a neutral position since the'thighs are no longer elevated. Further, much of the body weight is shifted onto the back of the thighs and the back of the knees, often causing poor circulation to the lower legs and pain when sitting for extended periods of time.

Another seat support device, marketed under the tradename Bottoms-Up TM, is made available by Roloke Co. of Culver City, Calif., and has a multiple-contoured surface. Roloke Co. claims that such a device achieves neutral balanced pelvic-spinal alignment. However, such a device has been found to be less effective if not used with a properly positioned lumbar-supporting back cushion since it is difficult for one to maintain correct posture over extended period of time without supporting the entire surface of the back of the pelvis. Such a seat support device only provides support to the lower back area up to the base of the pelvis. Although Roloke Co. strongly suggests using a back support device in combination with the Bottoms-Up TM device, handling separate back and seat supports is cumbersome. Further, since the Bottoms-Up TM device is a rigid appliance, prolonged use the device can become uncomfortable, and transporting and storing the device is often difficult and inconvenient.

Clearly there is a need for a support device designed to significantly reduce pressure to the ishia and coccyx regions while elevating the thighs to facilitate moving the pelvis into a more neutral and orthopedically correct position. Such a needed device would also eliminate pressure to the back of the knees to allow proper blood circulation throughout the legs and feet while sitting over an extended period of time. Further, such a needed device would redistribute body weight more evenly over the entire seating surface without requiring a rigid seating surface that is cumbersome and inconvenient to transport. Such a needed device would further include a lumbar support means to support and increase comfort across the entire back of the pelvis and effectively neutralize the pelvic-spinal alignment for extended sitting periods. Still further, such a needed device would be extremely light weight and convenient to use and carry, would be fully adjustable so as to accommodate a variety of sizes of users and seat depths, and would be relatively inexpensive to manufacture. The present invention fulfills these needs and provides further related advantages.

SUMMARY OF THE INVENTION

The present invention is an apparatus for supporting a seated person. A seatrest cushion, for placement on a chair seat, has a back edge and an upward facing convex surface for receiving the thighs and buttocks of the seated person. A backrest cushion has a horizontal bottom edge and an outward facing convex surface for receiving the back of the seated person. A flexible attachment strip tethers the back edge of the seatrest cushion to the bottom edge of the backrest cushion and is capable of being folded or unfolded for moving the cushions closer together or farther apart, respectively. The backrest cushion may be held at various heights above the seatrest cushion, and the seatrest cushion may be held at various horizontal positions relative to the backrest cushion, depending on the extension of the strip. The backrest cushion is positionable over a wide range of angles with respect to the seatrest cushion for supporting a person in a partially reclined orientation. The strip supports the cushions in alignment.

An adjustable carrying strap is attached to the attachment strip and allows a person to sling the apparatus over one shoulder. Alternatively, the carrying strap may be slung over the other shoulder with the strap positioned diagonally across the upper torso so that the weight of the apparatus is evenly distributed. Alternatively, the carrying strap may be adjusted such that one may carry the device over one arm at the elbow, if desired. When carried, the seatrest and the backrest cushions lie in side-by-side contact. The carrying strap may be used to support the apparatus during portage, and may also be used to hold the seatrest cushion in position on the chair seat during use by looping the carrying strap around the backrest of the chair seat. A carrying handle may be attached to the strip for carrying the apparatus by hand.

The present invention significantly reduces pressure to the ishia and coccyx regions while redistributing such weight evenly over the entire seating surface. Further, the present invention includes a lumbar support means that increases the comfort and effectiveness of neutralizing the pelvic-spinal alignment for extended periods of time. Further, the present invention is adjustable to many sizes of backs and seat depths, and can be used for reclining as well as sitting. Further, the present device is convenient to use and carry, and is relatively inexpensive to manufacture. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
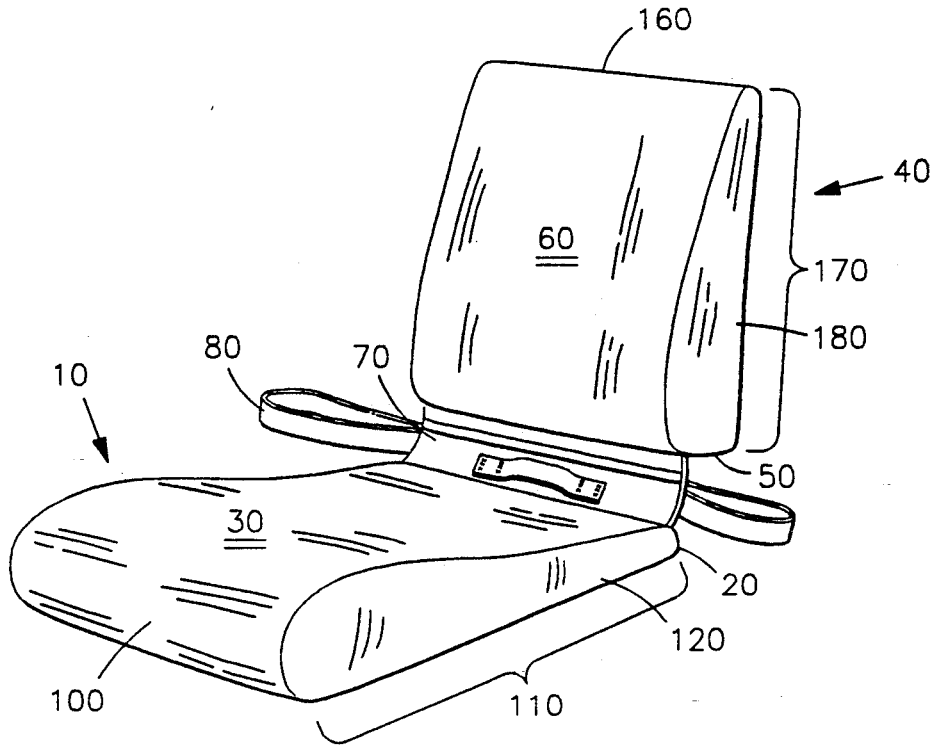
FIG. 1 is perspective illustration of the invention, illustrating a seatrest cushion and a backrest cushion.
Figure 2:
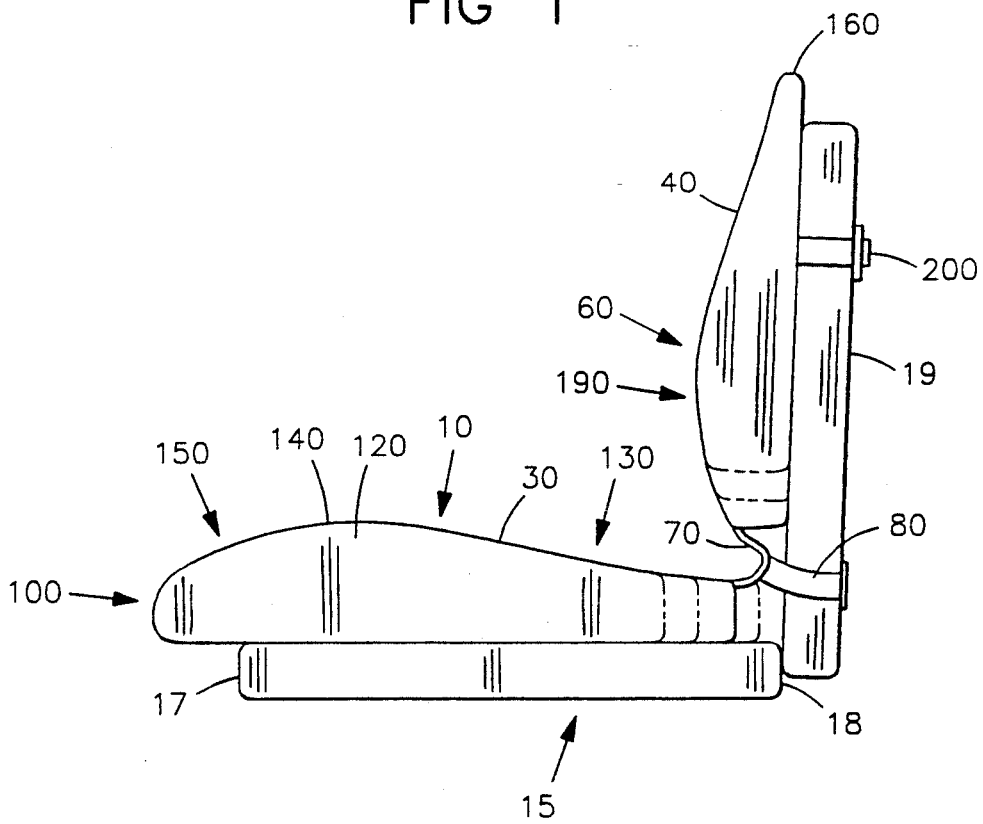
FIG. 2 is a left side elevational view of the invention, illustrating the invention as secured to a seat.
Figure 3:
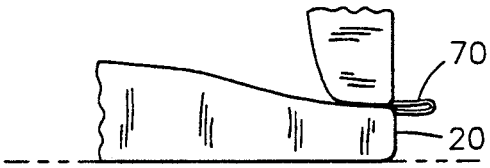
FIG. 3 is a partial left side elevational view of the invention, illustrating a folded flexible attachment strip connecting the seatrest cushion with the backrest cushion.
Figure 4:
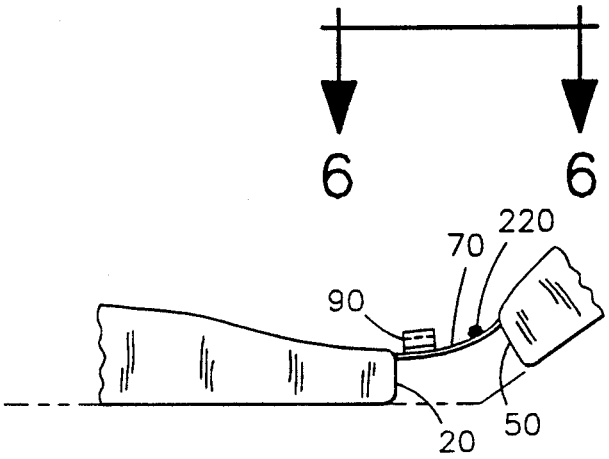
FIG. 4 is a partial left side elevational view of the invention, illustrating the attachment strip in an unfolded position, and further showing the backrest cushion on a reclined angle with respect to the seatrest cushion.

FIGS. 1 and 2 show an apparatus for supporting a person sitting in a seat 15. A seatrest cushion 10 is generally rectangular and has a front edge 100 positioned proximal to a front edge 17 of the seat 15 as the seat 15 supports the seatrest cushion 10. A back edge 20 of the seatrest cushion 10 is positioned proximal to a back edge 18 of the seat 15. The distance from the front edge 100 to the back edge 20 defines a length 110 of the cushion 10. The seatrest cushion 10 further includes two seatrest side edges 120 forming a perimeter of an upward facing surface 30 of the cushion 10. The surface 30 is for receiving the thighs and buttocks of the seated person (not shown). The thickness of the cushion 10 varies, being at a minimum at the back edge 20 and increasing as a smooth curve 130 until reaching a maximum thickness at a position 140 on the surface 30. The position 140 is approximately one-third of the length measured from the front edge 100 toward the back edge 20. The thickness of the cushion 10 falls in an arcuate curve 150 from position 140 to the front edge 100, such that the front edge 100 is below the inside of the knees of the seated person. The front edge 100 is a continuous curve.

A backrest cushion 40 has a horizontal bottom edge 50 and a top edge 160. The distance from the bottom edge 50 to the top edge 160 defines a height 170 of the backrest cushion 40. Two backrest side edges 180 form a perimeter of an outward facing convex surface 60. The backrest cushion 40 has a maximum thickness at a position 190 on the surface 60 that is approximately one-third of the height 170 of the backrest cushion 40 measured from the bottom edge 50 toward the top edge 160. The backrest cushion has a supporting strap 200 connected between the side edges 180 for holding the backrest cushion 40 in place on a chair backrest 19.

Figure 6:
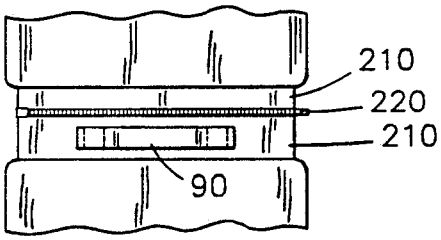
FIG. 6 is a partial top plan view of the attachment strip, taken generally along lines 6—6 of FIG. 4, and illustrating two halves of the attachment strip joined by a securing means.

A flexible attachment strip 70 tethers the back edge 20 of the seatrest cushion 10 to the bottom edge 50 of the backrest cushion 40. The strip 70 is capable of being folded for moving the cushions 10,40 closer together, and of being unfolded for moving the cushions 10,40 further apart. The backrest cushion 40 may be held at various heights above the seatrest cushion 10, and the seatrest cushion 10 may be held at various horizontal positions relative to the backrest cushion 40, depending on the extension of the strip 70. Moreover, the backrest cushion 40 is positionable over a wide range of angles with respect to the seatrest cushion 10. The strip 70 supports the cushions 10,40 such that the side edges 120,180 of the cushions 10,40 lie in mutual alignment. Preferably the attachment strip 70 is comprised of two halves 210 and are joined along a line approximately parallel to the back edge 20 of the seatrest cushion 10 by a securing means 220, such as a zipper or hook-and-loop type fastening material (FIG. 6). When the two halves 210 are separated, each cushion 10,40 may be used separately.

Figure 5:
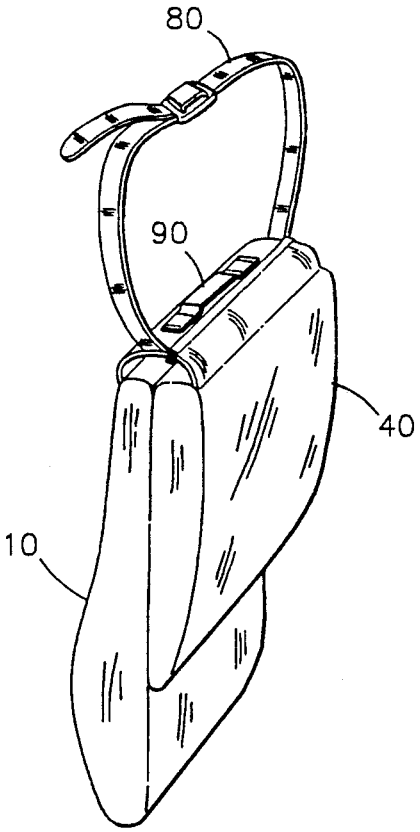
FIG. 5 is a perspective illustration of the invention, illustrating the seatrest cushion and backrest cushion in side-by-side contact for convenient carrying.

An adjustable carrying strap 80 is preferably attached to the attachment strip 70 such that the apparatus may be slung on a shoulder for carrying the apparatus. Alternatively, the carrying strap 80 may be adjusted so as to be carried over an arm at the elbow, if desired. When carried, the seatrest cushion 10 and the backrest cushion 40 are in side-by-side contact (FIG. 5). In this manner, the carrying strap 80 may be used to support the apparatus during portage, and may also be used to hold the seatrest cushion 10 in position on the chair seat 15 by looping the carrying strap 80 around the backrest 19 of the chair seat 15 (FIG. 20). Preferably a carrying handle 90 is attached to the strip 70 for carrying the apparatus in a hand (FIG. 5).

Preferably, each cushion 10,40 is made of a resilient material such that the seatrest cushion 10 is capable of supporting a greater load than the backrest cushion 40 in order for equal deformation of the cushions 10,40. The material of the seatrest cushion 10 is selected for a given load such that the difference between the thickness of the unloaded seatrest cushion 10 and the fully loaded cushion 10 does not exceed thirty percent of the thickness of the unloaded seatrest cushion 10, whereby the seatrest cushion 10 maintains its functional shape under compressional distortion. Clearly, each cushion 10,40 may have a resilient, ornamental outer covering such that the aesthetic appearance of the apparatus is pleasing (not shown). Such a covering could be made from a cotton, wool, leather, nylon, or other material, and may be colored and patterned to suit individual taste. Such a covering might be selected to match that of an individual's chair 15, for example. Further, such a cover could be included on the strip 70, the carrying strap 80, and the carrying handle 90 such that the entire apparatus has the covering.

In operation, much of the weight of the seated person is even redistributed onto the entire seating surface by directing the weight more toward the thighs and away from the coccyx area thereby alleviating pressure on the coccyx and ishia which usually support an undue amount of the total weight, while the entire back of the pelvis of the seated person receives improved lumbar support. Pressure behind the knees is eliminated due to the arcuate curve at the front of the seat cushion so that the front edge is below the inside of the knees. Moreover, the pelvis-spinal alignment is neutralized, increasing the amount of time a person can remain seated in the device without experiencing discomfort.

While the invention has been described with reference to a preferred embodiment, it is to be clearly understood by those skilled in the art that the invention is not limited thereto. Rather, the scope of the invention is to be interpreted only in conjunction with the appended claims.

I claim:

1. An apparatus for supporting a seated person comprising:

a seatrest cushion for placement on a chair seat, the cushion having a back edge and an upward facing convex surface for receiving the thighs and buttocks of the seated person;

a backrest cushion having a horizontal bottom edge, and an outward facing convex surface for receiving the back of the seated person; and a flexible attachment strip tethering the back edge of the seatrest cushion to the bottom edge of the backrest cushion, the strip capable of being folded for moving the cushions closer together, and of being unfolded for moving the cushions further apart, so that the backrest cushion may be held at various heights above the seatrest cushion, and the seatrest cushion may be held at various horizontal positions relative to the backrest cushion depending on the extension of the strip, the backrest cushion being positionable over a wide range of angles with respect to the seatrest cushion for supporting a person in a partially reclined orientation, the strip supporting the cushions in alignment, whereby the weight of the seated person is directed onto the thighs alleviating pressure on the coccyx area while the lower back of the seated person receives improved support.

2. The apparatus of claim 1 further including a carrying strap attached to the attachment strip, the carrying strap for slinging the apparatus on a shoulder for carrying the apparatus with the seatrest and the backrest cushions in side-by-side contact, whereby the carrying strap may be used to support the apparatus during portage and may be used to hold the seatrest cushion in position on the chair seat by looping the carrying strap around the backrest of the chair seat.

3. The apparatus of claim 1 further including a carrying handle attached on the strip for carrying the apparatus in a hand.

4. An apparatus for supporting a seated person comprising:

a seatrest cushion for placement on a chair seat, the cushion being approximately rectangular with a front edge positioned proximal a front edge of the seat, a back edge positioned proximal a back edge of the seat, the distance from the front edge to the back edge defining a length of the cushion, and two seatrest side edges, the edges forming a perimeter of an upward facing surface of the cushion, the surface for receiving the thighs and buttocks of the seated person, the cushion having a varying thickness, said thickness being at a minimum at the back edge, and increasing in thickness as a smooth curve until reaching a maximum thickness at a position on the surface, said position being at approximately one-third of the length measured from the front edge toward the back edge, the thickness falling in an arcuate curve from the maximum point to the front edge such that the front edge is below the inside of the knees of the seated person, the front edge being a full radius;

a backrest cushion having a bottom edge, a top edge, the distance from the bottom edge to the top edge defining a height of the backrest cushion, and two backrest side edges, the edges forming a perimeter of an outward facing convex surface, the backrest cushion having maximum thickness at a position on the surface, said position being approximately one-third of the height of the backrest cushion measured from the bottom edge toward the top edge, the backrest cushion having a supporting strap connected between the side edges for holding the backrest in place on a chair backrest; and a flexible attachment strip tethering the back edge of the seatrest cushion to the bottom edge of the backrest cushion, the strip capable of being folded for moving the cushions closer together, and of being unfolded for moving the cushions further apart, so that the backrest cushion may be held at various heights above the seatrest cushion, and the seatrest cushion may be held at various horizontal positions relative to the backrest cushion depending on the extension of the strip, the backrest cushion being positionable over a wide range of angles with respect to the seatrest cushion, the strip supporting the cushions such that the side edges of the cushions lie in mutual alignment, whereby the weight of the seated person is directed onto the thighs alleviating pressure on the coccyx area while the lower back of the seated person receives improved support.

5. The apparatus of claim 4 further including a carrying strap attached to the attachment strip, the carrying strap for slinging the apparatus on a shoulder for carrying the apparatus with the seatrest and backrest cushions in side-by-side contact, whereby the carrying strap may be used to support the apparatus during portage and may be used to hold the seatrest cushion in position on the chair seat by looping the carrying strap around the backrest of the chair seat.

6. The apparatus of claim 4 further including a carrying handle attached on the strip for carrying the apparatus in a hand.

7. The apparatus of claim 4 wherein the attachment strip is comprised of two halves, the halves being joined along a line approximately parallel to the back edge of the seatrest cushion by a securing means such that the attachment strip may be separated to allow the use of each of the cushions separately.

8. An apparatus for supporting a seated person comprising:

a seatrest cushion for placement on a chair seat, the cushion having a horizontal back edge and an upward facing convex surface for receiving the thighs and buttock of the seated person;

a backrest cushion having a horizontal bottom edge, and an outward facing convex surface for receiving the back of the seated person; and a flexible attachment strip tethering the back edge of the seatrest cushion to the bottom edge of the backrest cushion, the strip capable of being folded for moving the cushions closer together, and of being unfolded for moving the cushions further apart, so that the backrest cushion may be held at various heights above the seatrest cushion, and the seatrest cushion may be held at various horizontal positions relative to the backrest cushion depending on the extension of the strip, the backrest cushion being positionable over a wide range of angles with respect to the seatrest cushion for supporting a person in a partially reclined orientation, the strip supporting the cushions in alignment, whereby the weight of the seated person is directed onto the thighs alleviating pressure on the coccyx area while the lower back of the seated person receives improved support;

a carrying strap attached to the attachment strip, the carrying strap for slinging the apparatus on a shoulder for carrying the apparatus with the seatrest and the backrest cushions in side-by-side contact, such that the carrying strap may be used to support the apparatus during portage and may be used to hold the seatrest cushion in position on the chair seat by looping the carrying strap around the backrest on the chair seat; and a carrying handle attached on the strip for carrying the apparatus in a hand.

9. An apparatus for supporting a seated person comprising:

a seatrest cushion for placement on a chair seat, the cushion being approximately rectangular with a front edge positioned proximal a front edge of the seat, a back edge positioned proximal a back edge of the seat, the distance from the front edge to the back edge defining a length of the cushion, and two seatrest side edges, the edges forming a perimeter of an upward facing surface of the cushion, the surface for receiving the thighs and buttock of the seated person, the cushion having a variable thickness, said thickness being at a minimum at the back edge, and increasing in thickness as a smooth curve until reaching a maximum thickness at a position on the surface, said position being at approximately one-third of the length measured from the front edge toward the back edge, the thickness falling in an arcuate curve from the maximum point to the front edge such that the front edge is below the inside of the knees of the seated person, the front edge being a full radius;

a backrest cushion having a bottom edge, a top edge, the distance from the bottom edge to the top edge defining a height of the backrest cushion, and two backrest side edges, the edges forming a perimeter of an outward facing convex surface, the backrest cushion having maximum thickness at a position on the surface, said position being approximately one-third of the height of the backrest cushion measured from the bottom edge toward the top edge, the backrest cushion having a supporting strap connected between the side edges for holding the backrest in place on a chair backrest; and a flexible attachment strip tethering the back edge of the seatrest cushion to the bottom edge of the backrest cushion, the strip capable of being folded for moving the cushions closer together, and of being unfolded for moving the cushions further apart, so that the backrest cushion may be held at various heights above the seatrest cushion, and the seatrest cushion may be held at various horizontal positions relative to the backrest cushion depending on the extension of the strip, the backrest cushion being positionable over a wide range of angles with respect to the seatrest cushion, the strip supporting the cushions such that the side edges of the cushions lie in mutual alignment, whereby the weight of the seated person is directed onto the thighs alleviating pressure on the coccyx area while the lower back of the seated person receives improved support;

a carrying strap attached to the attachment strip, the carrying strap for slinging the apparatus on a shoulder for carrying the apparatus with the seatrest and backrest cushions in side-by-side contact, whereby the carrying strap may be used to support the apparatus during portage and may be used to hold the seatrest cushion in position on the chair seat by looping the carrying strap around the backrest of the chair seat; and a carrying handle attached on the strip for carrying the apparatus in a hand.

* * * * *